US006509838B1

(12) United States Patent
Payne et al.

(10) Patent No.: US 6,509,838 B1
(45) Date of Patent: Jan. 21, 2003

(54) CONSTANT CURRENT FLAME IONIZATION CIRCUIT

(76) Inventors: Peter P. Payne, 118 N. Chester Ave., Park Ridge, IL (US) 60068; Stephan E. Schmidt, 10 Janis Ter., Woburn, MA (US) 01801; Kristin Powers Goppel, 24 Brentwood Dr., Shrewsbury, MA (US) 01545; Darrell J. King, 30 Long Ave., Belmont, MA (US) 02478; Stephen M. Tobin, 89 Channing Rd., Watertown, MA (US) 02472; J. Thomas Fowler, 12 Old Salem Rd., Marblehead, MA (US) 01943

( * ) Notice: Subject to any disclaimer, the term of this patent is extended or adjusted under 35 U.S.C. 154(b) by 0 days.

(21) Appl. No.: 09/569,506

(22) Filed: May 12, 2000

Related U.S. Application Data

(60) Provisional application No. 60/181,005, filed on Feb. 8, 2000.

(51) Int. Cl.[7] ..... G08B 17/12

(52) U.S. Cl. ..... 340/579; 340/629; 340/501; 340/507; 431/25; 431/75; 250/389

(58) Field of Search ..... 340/629, 501, 340/507, 509, 538, 628, 630, 579; 73/31.06; 96/23, 24; 431/12, 13, 25, 22, 24, 23, 26, 75, 76, 77, 78; 250/389, 250, 370.01, 388, 374, 370.09

(56) References Cited

U.S. PATENT DOCUMENTS

| | | | | | |
|---|---|---|---|---|---|
| 3,842,409 | A | * | 10/1974 | Mayer | 340/512 |
| 4,023,152 | A | * | 5/1977 | Okuda et al. | 340/629 |
| 4,079,271 | A | * | 3/1978 | Peil | 307/110 |
| 4,088,986 | A | * | 5/1978 | Boucher | 340/521 |
| 4,123,656 | A | * | 10/1978 | Kajii | 250/381 |
| 4,157,506 | A | * | 6/1979 | Spencer | 307/653 |
| 4,166,380 | A | * | 9/1979 | Batz | 73/31.06 |
| 4,222,267 | A | * | 9/1980 | Aldrich | 73/304 C |
| 4,967,187 | A | * | 10/1990 | Dumas et al. | 340/628 |
| 5,173,683 | A | * | 12/1992 | Brighenti et al. | 340/505 |
| 5,472,337 | A | * | 12/1995 | Guerra | 431/78 |
| 5,971,745 | A | | 10/1999 | Bassett et al. | 431/25 |
| 6,056,808 | A | * | 5/2000 | Krause | 96/24 |
| 6,414,318 | B1 | * | 7/2002 | Uber, III et al. | 250/389 |

* cited by examiner

*Primary Examiner*—Benjamin C. Lee
(74) *Attorney, Agent, or Firm*—Mark E. Fejer

(57) ABSTRACT

In a flame ionization sensor type gas combustion control apparatus, the sensor is provided with a power supply which will increase the voltage as contamination build up occurs on the in-flame sensor electrode thereby keeping a constant sensor current and enabling the sensor to perform as intended even though insulative contaminant build up is present on the electrode.

18 Claims, 5 Drawing Sheets

CONSTANT CURRENT FLAME IONIZATION CIRCUIT

This application claims benefit of Ser. No. 60/181,005, filed Feb. 8, 2000.

BACKGROUND OF THE INVENTION

1. Field of the Invention

The present invention relates generally to temperature probes, or sensor tips, of the type used for the control and safety monitoring of gaseous fuel burners as used in various heating, cooling and cooking appliances. In particular, the present invention relates to flame ionization sensor probes used in gas combustion control/safety environments where contamination coating of the in-flame sensor probe shortens the useful life of the sensor.

2. Discussion of the Related Art

Flame ionization sensing provides known methods and apparatus for monitoring the presence of a flame for a gaseous fuel burner.

It is known that hydrocarbon gas flames conduct electricity because charged species (ions) are formed by the chemical reaction of the fuel and air. When an electrical potential is established across the flame, the ions form a conductive path, and a current flows. Using known components, the current flows through a circuit including a flame ionization sensor, a flame and a ground surface (flameholder or ground rod).

FIG. 1 illustrates a flame ionization sensor system 10 with a typical sensor/burner circuit loop as may be used in accordance with the present invention. Flame ionization sensor 11 having a probe 12, will be mounted near the burner 13. The output 15 of sensor 11 will be fed into a computer-controller 17. The sensor loop can provide information regarding the status of a flame 18 in the burner 13. If there is no flame, then the sensor 11 will not generate a signal which will cause the controller 17 to instruct the system to shut off fuel flow.

In utilizing a flame sensor as previously described, a voltage, such as a 120 AC voltage 21, will be applied across the sensor loop, with the flame holder, or burner 13, serving as the ground electrode 20. Flame contact between the sensor probe 12 and the burner 13 will close the circuit. The alternating current (AC) output of the sensor/ground circuit, can be rectified, if the ground electrode (flameholder or burner 13) is substantially larger in size than the positive electrode, since, due to the difference in electrode size, more current flows in one direction than in the other.

Flame ionization sensor probes 12 are thus electrodes, made out of a conductive material which is capable of withstanding high temperatures and steep temperature gradients. Hydrocarbon flames conduct electricity because of the charged species (ions) which are formed in the flame. Placing a voltage across the probe and the flameholder causes a current to flow when the flame closes the circuit.

Unfortunately it has been found that contaminants in the air stream of the fuel/air mixture can result in the build up of an insulating contamination layer on the probe, rendering it much less effective. At a certain level of coating, which prevents sufficient electron flow to the probe surface, the sensor is rendered useless, creating a premature or false system failure. Often these airborne contaminants are organosilicones found in personal and home care products which are oxidized by the flame 18 to silicon oxides (SiOx) which in turn build up through impact on the probe 12 providing the insulative contaminant coating.

It is thus desirable to find ways to increase the useful life of flame ionization sensor probes in spite of this insulative build up resulting from normal use of the flame ionization sensor system.

SUMMARY OF THE INVENTION

The voltage potential between the flame sensor and the burner (ground) is the driving force for the flame ionization signal, therefore an increased voltage should yield a higher signal in spite of the probe being covered with insulative contaminants. However, merely applying a higher sensor voltage will likely yield mixed results for increased sensor life, at least in part because the higher voltage may increase contaminant build up on the sensor probe. It was therefore determined that what was needed was a means of regulating the applied voltage to the minimum value needed for a desired flame signal, and incrementally increasing the applied voltage only as required, while limiting the circuit current overdrive ratio (ratio of maximum sensor signal to the minimum threshold detection level) and allowing for a low signal threshold equal to the baseline configuration of standard commercial sensor apparatus, despite the increasing voltage.

The present invention therefore provides a sensor circuit which maintains a reasonably constant current, e.g. 5 microamps, over the operating life of the furnace by incrementally increasing the sensor voltage as the contamination buildup increases. This circuit allows the flame sensor circuit to draw on a higher voltage as needed, without incurring circuit overdrive issues, thereby eliminating the need for raising the signal threshold. Laboratory trials have shown an improved time to failure of the sensor circuit of four to seven times the life of known, or baseline, sensor circuit models.

BRIEF DESCRIPTION OF THE DRAWINGS

The above-mentioned and other features and objects of this invention will be better understood from the following detailed description taken in conjunction with the drawings wherein.

DETAILED DESCRIPTION OF THE PREFERRED EMBODIMENTS

As mentioned above, the primary cause of failure for flame ionization sensors is believed to be SiOx contamination insulation of the sensor probe, or tip, which is exposed to the flame. The SiOx contamination problem was studied by accelerated life testing of an flame ionization sensor in various furnace units by introduction of organosilicone contaminants into the burner air stream through a compressed air bubbler. Dow 344 fluid available from Dow Chemical Co., consisting of ninety percent Dow D4 fluid and ten percent Dow D5 fluid was used in the contaminant vaporization apparatus. The organosilicones are oxidized in the burner flame to silicon oxides (SiOx) which are deposited by impact on the sensor probe surfaces. While the results mentioned are the result of the accelerated life testing, it is believed that all results may be validly extrapolated to the real time phenomena of flame ionization sensor failure.

Figure 1:
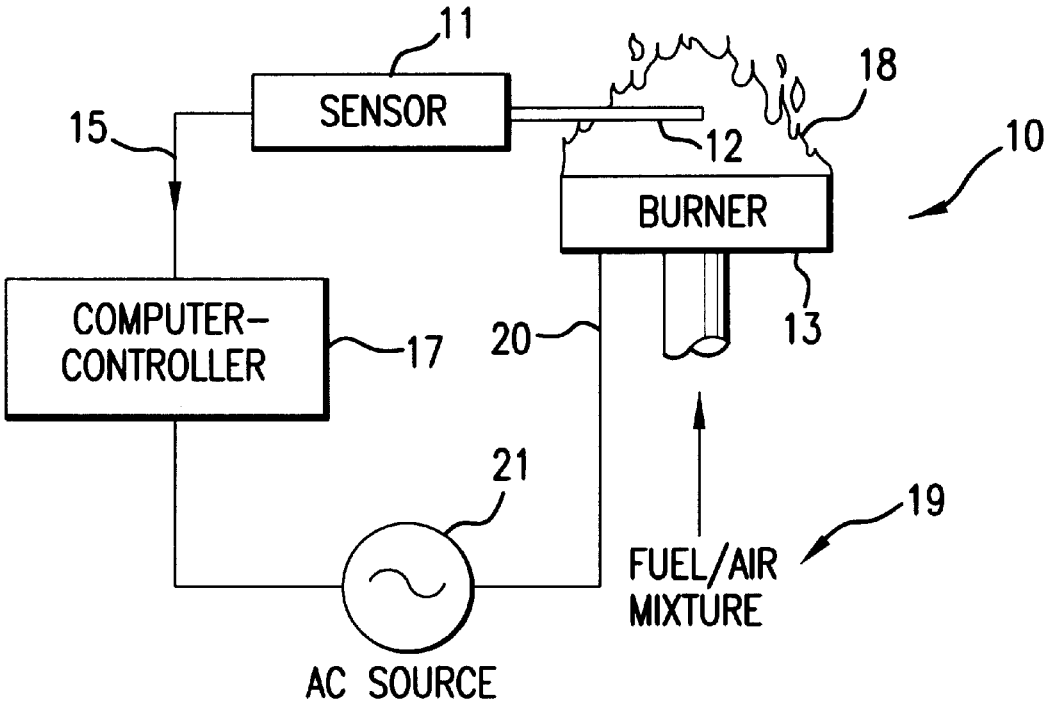
FIG.1 (PRIOR ART)
FIG. 1 illustrates the known arrangement of components for explanation of a flame ionization sensor circuit.
Figure 2:
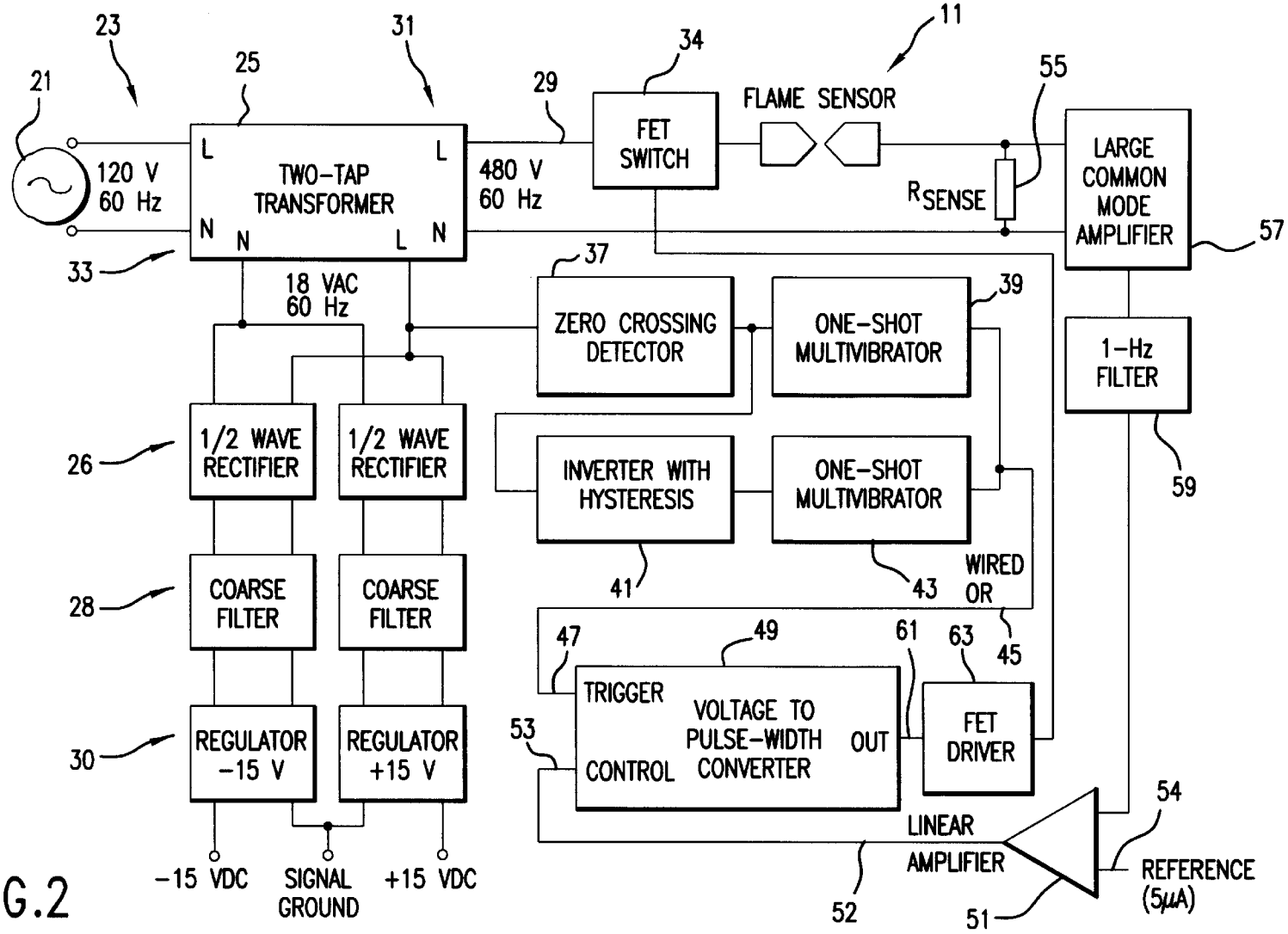
FIG. 2 is a block diagram of a constant current sensor circuit according to the present invention.

Referencing FIG. 2, the circuit 23 comprises a two-tap 4:1 step up transformer 25 increasing the 120 volt AC line voltage 21 to a 480 volts output 29 for operation of the AC source of the flame ionization sensor 11 at a first tap 31. The second tap 33 provides power through rectifiers 26, filters 28 and regulators 30 in known fashion for the amplifier and integrated circuit component DC power requirements for the control circuitry as set forth below.

The high side 29 of the 480 V ac source is then switched on/off by a controllable semiconductor switch 34, e.g. a field effect transistor or FET, at a rate that will provide an RMS voltage value just high enough to maintain the desired sensor current, e.g. 5 microamps. Alternatively, variable voltage may be obtained through use of a multi-tap transformer with selectable switching between taps of either the primary or secondary, a variac, a triac, or other known power control schemes or combinations thereof.

As the sensor resistance increases with SiOx buildup, the current feedback will cause the switching time to increase thereby increasing the RMS voltage driving the sensor until the reference current is reestablished.

Figure 3:
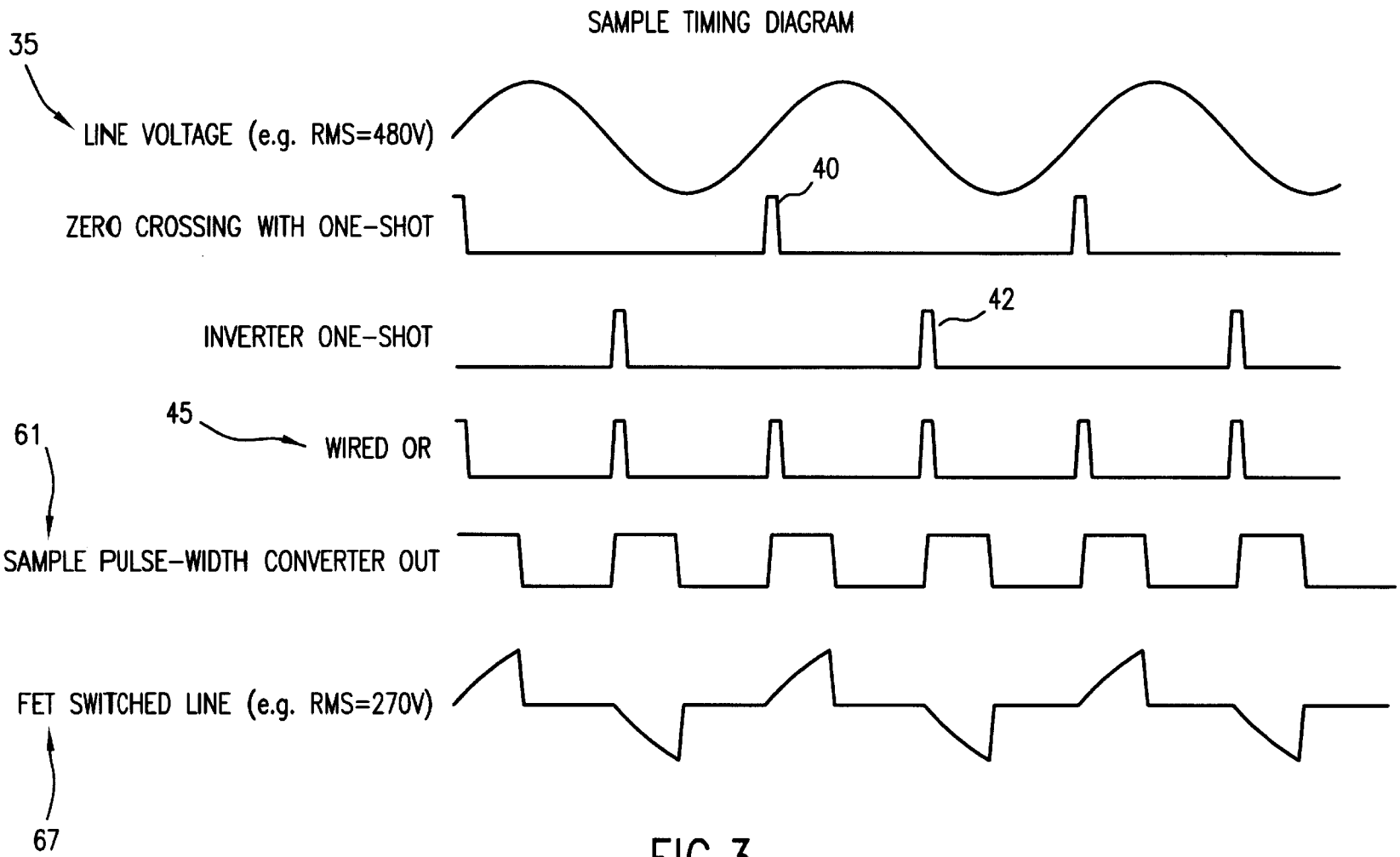
FIG. 3 is a timing diagram illustrating the operation of the embodiment of FIG. 2.

FIG. 3 shows a sample timing diagram illustrating the switch timing and its effect on the sensor voltage. With reference to FIGS. 2 and 3, the stepped up line voltage wave form from the first tap 31 of the transformer 25 is shown at reference number 35. For each positive going zero crossing of the wave form 35 the zero crossing detector 37 and its associated first one shot multivibrator 39 output a positive pulse 40. For each negative going zero crossing of the wave form 35 an invertor with hysteresis 41, receiving the output of the zero crossing detector 37, and its associated second one shot multivibrator 43 output a positive pulse 42. The positive pulse streams of 40 and 42 are then combined, as by wired OR, into a single stream 45 which is input to the trigger input 47 of a voltage-to-pulse width converter 49.

The output 52 of a linear amplifier 51 comparing the sensed resistance across the flame ionization sensor 11 and the desired constant current reference 54, e.g. five microamps, is fed to the control input 53 of the voltage-to-pulse width converter 49. The sensed resistance is gathered from a sensing resistor 55 in series with the flame ionization sensor 11, which is amplified with a large common mode amplifier 57, i.e. an amplifier with large common mode voltage handling capability, and then filtered with a low pass one hertz (1 Hz) filter 59 to extract the DC component. The output 61 of the voltage-to-pulse width converter 49 is then fed to a FET driver 63 which drives the duty cycle, seen at reference number 67, of the controllable switch, or FET 65, at an increased RMS voltage level, e.g. 270 Vrms, in order to keep the flame ionization sensor current output at a level which compensates for the increasing resistivity of the sensor due to contaminant build up on the probe.

Figure 4A:
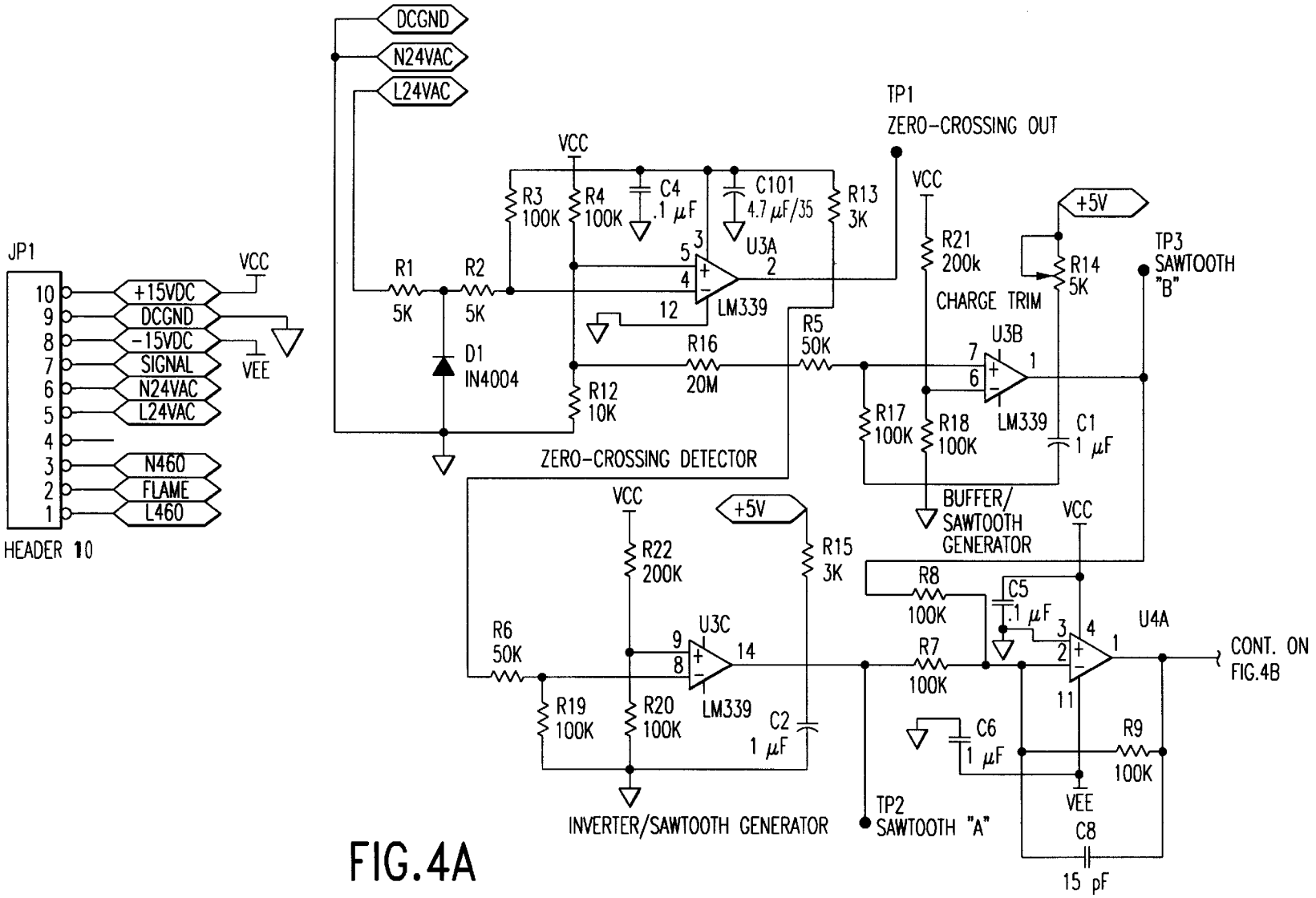
FIGS. 4A and 4B show a schematic of an alternative circuit to the block diagram of FIG. 2.
Figure 4B:
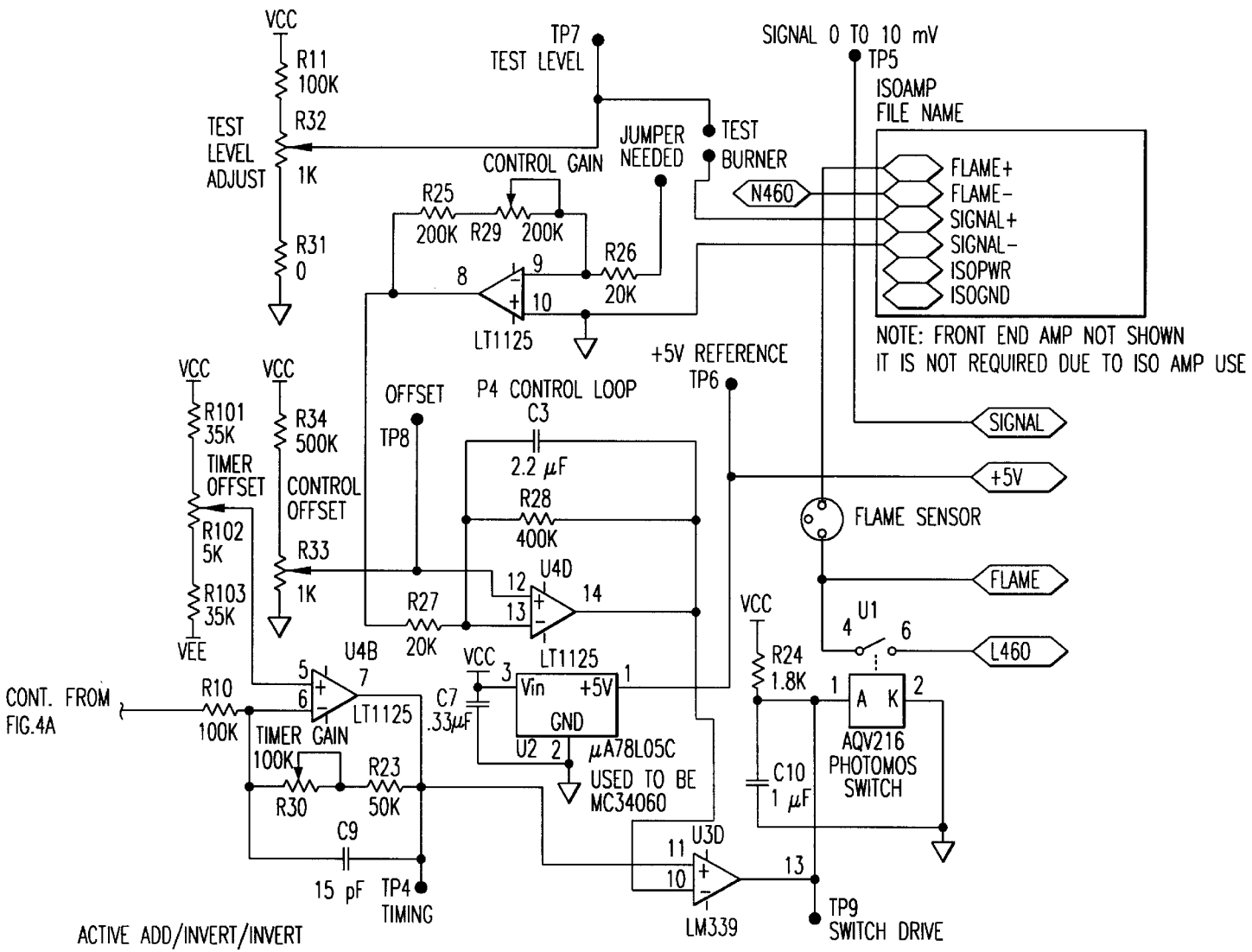

While in the foregoing specification this invention has been described in relation to certain preferred embodiments thereof, and many details have been set forth for purpose of illustration, it will be apparent to those skilled in the art that the invention is susceptible to additional embodiments, such as that of FIGS. 4A and 4B and that certain of the details described herein can be varied considerably without departing from the basic principles of the invention.

We claim:

1. A flame ionization sensor comprising:

means for sensing resistance of the flame ionization sensor; and means for supplying increasing voltage to the sensor in response to an increase in the resistance.

2. The flame ionization sensor of claim 1 further comprising:

means for stepping up a line voltage.

3. A flame ionization sensor comprising:

a controllable switch for controlling power to the flame ionization sensor;

means for routing a line voltage to the controllable switch;

a resistance sensor in series with the flame ionization sensor; and means for increasing a duty cycle of the controllable switch in response to increased resistance across the flame ionization sensor.

4. A flame ionization sensor comprising:

means for routing a line voltage to the flame ionization sensor;

means for stepping up a line voltage to the flame ionization sensor;

a controllable switch between the line voltage and the flame ionization sensor;

means for sensing resistance across the flame ionization sensor; and means for supplying increased voltage to the flame ionization sensor in response to increased resistance across the flame ionization sensor.

5. The flame ionization sensor of claim 4 further comprising:

the means for stepping up a line voltage being a transformer.

6. The flame ionization sensor of claim 5 further comprising:

the controllable switch being a semiconductor switch.

7. The flame ionization sensor of claim 6 further comprising:

the controllable switch being a field effect transistor.

8. The flame ionization sensor of claim 6 further comprising:

the means for sensing resistance further including a sensing resistor in series with t he flame ionization sensor.

9. The flame ionization sensor of claim 8 further comprising:

the means for sensing resistance further including a large common mode amplifier in parallel with the sensing resistor.

10. The flame ionization sensor of claim 9 further comprising:

the means for sensing resistance further including a low pass filter in series with an output of the large common mode amplifier.

11. The flame ionization sensor of claim 10 further comprising:

the means for sensing resistance further including a linear amplifier with a constant current reference in series with an output of the low pass filter.

12. The flame ionization sensor of claim 11 further comprising:

the means for supplying increased voltage further including a timing circuit.

13. The flame ionization sensor of claim 12 further comprising:

the timing circuit including a zero crossing detector and a sawtooth wave generator attached to an output of the transformer.

14. The flame ionization sensor of claim 12 further comprising:

a voltage-to-pulse width converter using an output of the timing circuit as a trigger input and using an output of the linear amplifier as a control signal and outputting a duty cycle signal to the controllable switch.

15. The flame ionization sensor of claim 14 further comprising:

a switch driver in series between the voltage-to-pulse width converter and the controllable switch.

16. The flame ionization sensor of claim 5 further comprising:

the transformer having an output for providing a DC power supply to the means for sensing and the means for supplying increased voltage.

17. A method of operating an flame ionization sensor comprising:

running the flame ionization sensor at a first voltage;

monitoring resistance across the flame ionization sensor; and supplying the flame ionization sensor with a voltage above the first voltage in response to increased resistance across the flame ionization sensor.

18. The method of claim 17 wherein the step of supplying the flame ionization sensor with a voltage above the first voltage includes increasing the duty cycle of a switch which controls power to the flame ionization sensor.

* * * * *